US008600271B2

(12) United States Patent
Innami et al.

(10) Patent No.: US 8,600,271 B2
(45) Date of Patent: Dec. 3, 2013

(54) MAGNET ROLLER, DEVELOPER HOLDER ELEMENT, DEVELOP UNIT, PROCESS CARTRIDGE, AND IMAGE FORMING APPARATUS

(75) Inventors: Takashi Innami, Atsugi (JP); Kyohta Koetsuka, Fujisawa (JP); Yoshiyuki Takano, Hachioji (JP); Noriyuki Kamiya, Yamato (JP); Masayuki Ohsawa, Atsugi (JP); Takumi Terasaka, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 258 days.

(21) Appl. No.: 13/085,894

(22) Filed: Apr. 13, 2011

(65) Prior Publication Data

US 2011/0262190 A1 Oct. 27, 2011

(30) Foreign Application Priority Data

Apr. 26, 2010 (JP) ..... 2010-100723

(51) Int. Cl.
*G03G 15/09* (2006.01)

(52) U.S. Cl.
USPC ..... 399/277

(58) Field of Classification Search
USPC ..... 399/267, 275–277, 282
See application file for complete search history.

(56) References Cited

U.S. PATENT DOCUMENTS

| | | | | |
|---|---|---|---|---|
| 7,890,030 | B2 | 2/2011 | Innami et al. | |
| 2004/0234299 | A1 * | 11/2004 | Koetsuka et al. | 399/267 |
| 2008/0232865 | A1 | 9/2008 | Terashima et al. | |

FOREIGN PATENT DOCUMENTS

| | | |
|---|---|---|
| CN | 101271306 A | 9/2008 |
| JP | 8-28294 | 1/1996 |
| JP | 10-221958 | 8/1998 |
| JP | 11-115002 | 4/1999 |
| JP | 2001-312142 | 11/2001 |
| JP | 2001-319810 | 11/2001 |
| JP | 2002-287500 | 10/2002 |
| JP | 3826622 | 7/2006 |
| JP | 2008-10782 | 1/2008 |
| JP | 2008-40007 | 2/2008 |
| JP | 2009-217208 | 9/2009 |
| JP | 2010-8471 | 1/2010 |

OTHER PUBLICATIONS

Chinese official action dated Jul. 3, 2012 (and English translation of the official action) in corresponding Chinese patent application No. 201110104883.7.

* cited by examiner

*Primary Examiner* — Hoang Ngo
(74) *Attorney, Agent, or Firm* — Cooper & Dunham LLP

(57) ABSTRACT

A magnet roller includes a magnetic field generator being columnar, a support element being columnar, coaxially provided at both ends of the magnetic field generator, and whose diameter is smaller than that of the magnetic field generator, a level element extending along an axis of the magnetic field generator with a distance from the axis, the distance larger than the diameter of the support element, and a high magnetic power element being a main magnetic pole provided on the level element, extending long along the axis of the magnetic field generator.

6 Claims, 12 Drawing Sheets

MAGNET ROLLER, DEVELOPER HOLDER ELEMENT, DEVELOP UNIT, PROCESS CARTRIDGE, AND IMAGE FORMING APPARATUS

CROSS REFERENCE TO RELATED APPLICATION

The present application is based on and claims priority from Japanese Patent Application No. 2010-100723, filed on Apr. 26, 2010, the disclosure of which is hereby incorporated by reference in its entirety.

BACKGROUND OF THE INVENTION

1. Field of the Invention

The present invention relates to a magnet roller to deliver a developer to a latent image support element used in an image forming apparatus such as a copier, a facsimile machine, or a printer. It also relates to a developer holder element including the magnet roller, a develop unit including the developer holder element, a process cartridge including the develop unit, and an image forming apparatus including the process cartridge.

2. Description of the Prior Art

Generally, an electrophotographic image forming apparatus generates visual images by forming an electrostatic latent image on a latent image support element as a photoconductor drum or belt based on image information and developing it with a develop unit. Magnetic brush developing is widely used in such an electrophotographic develop process. For example, with use of two-component developer, the developer is magnetically attracted onto an outer circumference of a developer holder element as a develop roller to form a magnetic brush. By electric field in a develop area between the latent image support element and the developer holder element, toner is attracted from the magnetic brush onto a latent image on the latent image support element.

A develop roller used in the magnetic brush developing comprises a cylindrical develop sleeve made of non-magnetic materials and a magnet roller contained in the develop sleeve to form developer chains on the surface of the develop sleeve by a magnetic force. Chains of magnetic carrier contained in the developer are formed on the develop sleeve along magnetic field lines (magnetic force) of the magnet roller and toner is attracted to the chains of magnetic carrier.

Electric color copiers and color printers are now widespread and they generally need four develop units for four colors (yellow, magenta, cyan, black). To downsize an image forming apparatus, needless to say that the develop unit and the develop roller contained in the develop unit have to be downsized.

Downsizing of the develop roller is realized by decreasing diameter of the magnet roller. However, a smaller magnet roller generally made of ferrite resin includes a less magnet volume so that it fails to generate necessary magnetic force.

Aiming to solve such a problem, Japanese Patent Application Publication No. 2010-8471 (Reference 1) discloses a magnet roller including a columnar magnetic field generator of ferrite resin with a groove on the outer face in the axial direction in which a high magnetic power earth magnet block is fixed. This magnet roller is of a small diameter but can generate high magnetic force.

However, when the magnetic field generator of this magnet roller is molded by magnetic field injection molding, a periphery of the groove and a portion facing the groove may be hardened and shrunk. This may cause a problem that due to a difference in the shrinkage of the two portions, the magnetic field generator warps. Such a warped magnet roller cannot generate magnetic field evenly in the axial direction in a develop process and deliver the developer evenly, causing a degradation in image quality.

Japanese Patent No. 3826622 (Reference 2) discloses a warpage correction device for a magnet roller configured to locally cool down a predetermined portion of a magnet roller removed from a mold in incompletely hardened state while rotating the magnet roller. This device locally cools down a portion of the outer circumference of the magnet roller opposite by about 180 degrees to a warped concave portion to create a hardened layer. Then, it cools down the entire magnet roller to mainly shrink the semi-hardened concave portion and negate the warpage of the magnet roller.

Another problem with the magnet roller having the groove in Reference 1 is that depending on a diameter of the magnet roller, the groove in which the earth magnet block is placed need be formed to be deeper than the positions of support portions of the magnet roller. This leads to weakening the support portions since the groove is shrunk when molded and further causing a breakage or an inclination of the support portions immediately after the molding, in assembly or during use of the magnet roller.

The warpage correction device disclosed in Reference 2 has a problem that stress may occur inside the magnet roller due to the local cool-down and cause a distortion therein over time. Similarly to the warped magnet roller, such a distorted magnet roller cannot generate magnetic field evenly in the axial direction in a develop process and deliver the developer evenly, causing a degradation in image quality. Also, another process to attach the magnet roller to this warpage correction device has to be added in the manufacturing process, increasing manufacture costs.

In order to prevent the breakage or inclination of the support elements of the magnet roller, Japanese Patent Application Publication No. 2009-217208 (Reference 3) discloses a magnet roller having a groove whose depth about the support elements is shallower than the diameter of the support elements. However, there still remains the warpage problem unsolved. Especially, for the purpose of generating a high magnetic force at a main magnetic pole, the magnet roller in a small diameter has to be provided with a groove deeper than the diameter of the support elements into which a high power magnet block is placed. This is likely to bring about warpage of the magnet roller.

SUMMARY OF THE INVENTION

The present invention aims to provide a magnet roller which can generate a high magnetic force from a main magnetic pole and is prevented from warping when molded and distorting over time as well as breakage or inclination of a support element. The present invention also aims to provide a developer holder element including the magnet roller, a develop unit including the developer holder element, a process cartridge including the develop unit, and an image forming apparatus including the process cartridge.

According to one aspect of the present invention, a magnet roller comprises a magnetic field generator being columnar; a support element being columnar, coaxially provided at both ends of the magnetic field generator, and whose diameter is smaller than that of the magnetic field generator; a level element extending along an axis of the magnetic field generator with a distance from the axis, the distance larger than the diameter of the support element; and a high magnetic power element being a main magnetic pole provided on the level element, extending long along the axis of the magnetic field generator.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENTS

Hereinafter, one embodiment of the present invention will be described in detail with reference to FIG. 1 to FIG. 12.

Figure 1:
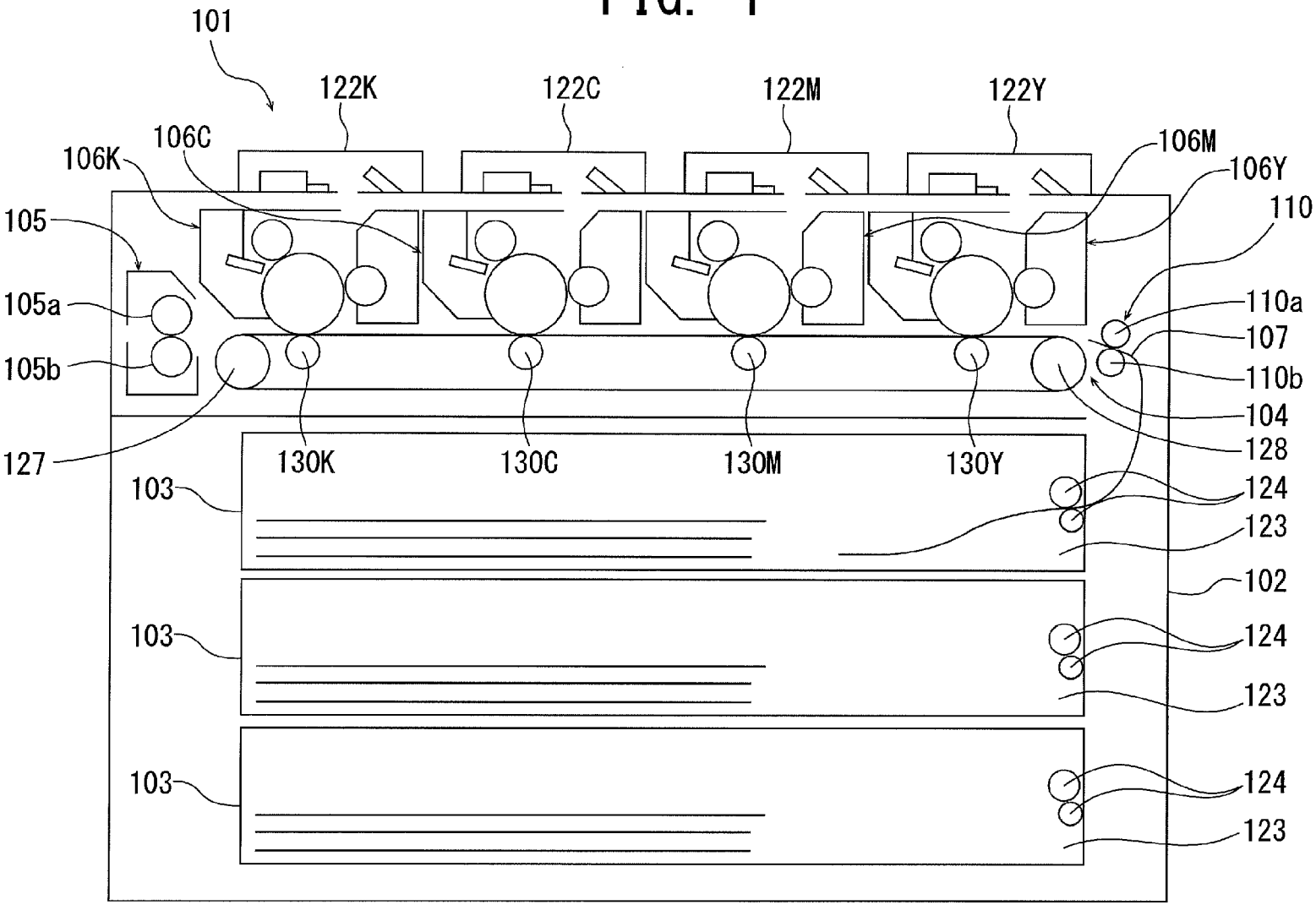
FIG. 1 cross-sectionally shows an image forming apparatus according to one embodiment of the present invention.
Figure 2:
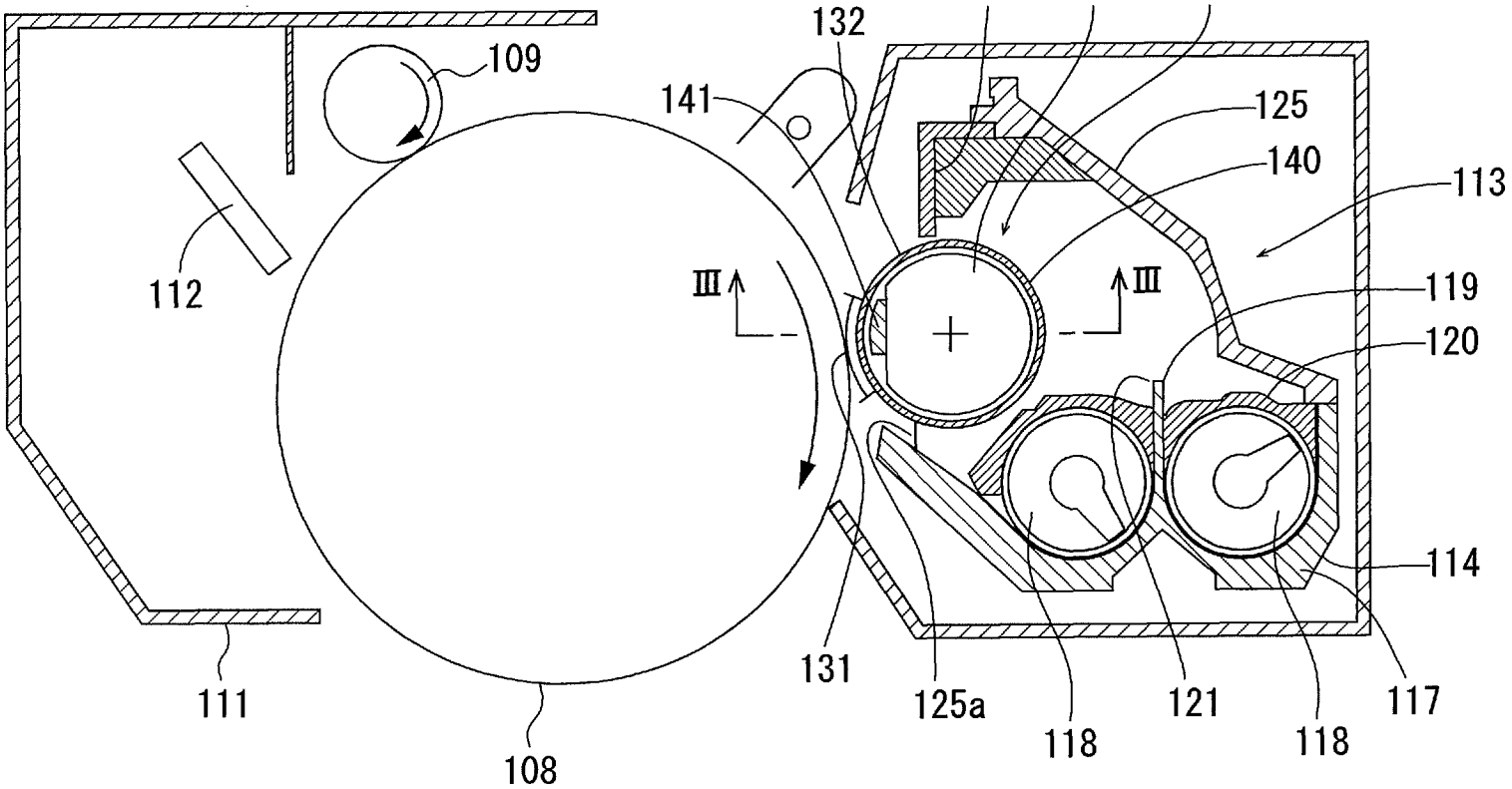
FIG. 2 cross-sectionally shows a develop unit and a process cartridge incorporating the develop unit according to one embodiment of the present invention.
Figure 3:
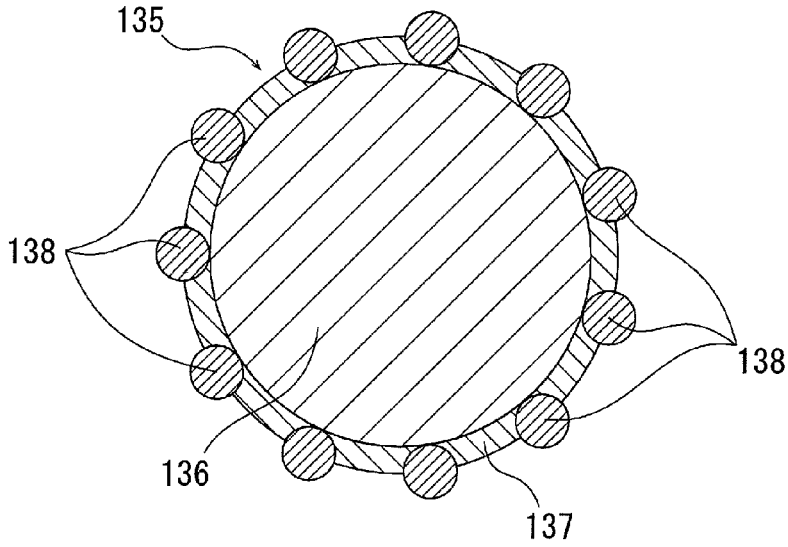
FIG. 3 cross-sectionally shows a magnetic carrier contained in a developer used in the develop unit of FIG. 2.
Figure 4:
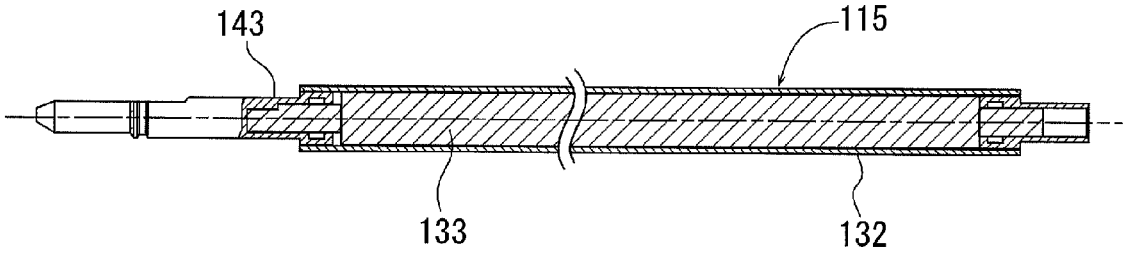
FIG. 4 cross-sectionally shows a developer holder element along the axis according to one embodiment of the present invention.
Figure 5:
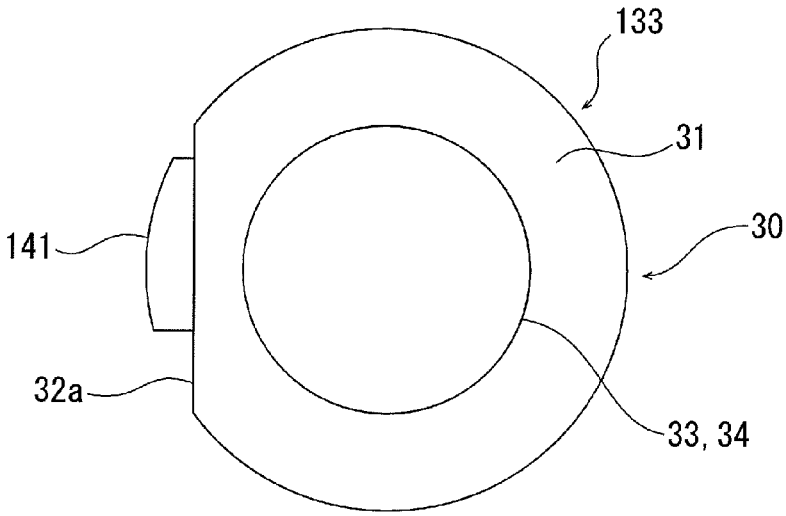
FIG. 5 is a front view of a magnet roller according to one embodiment of the present invention.
Figure 6:
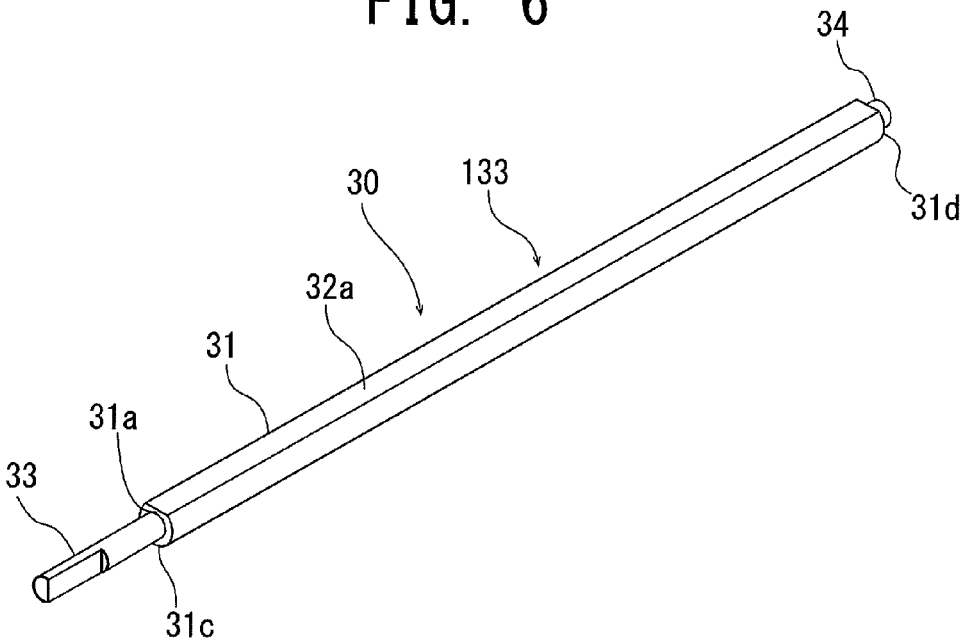
FIG. 6 is a perspective view of a magnetic field generator of the magnet roller of FIG. 5.
Figure 7:
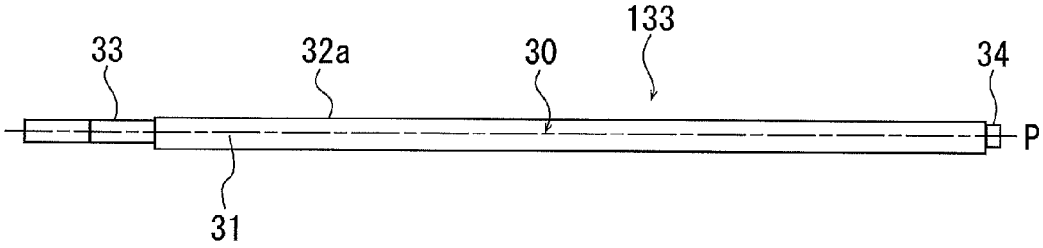
FIG. 7 is a side view of the magnetic field generator of FIG. 6.
Figure 8:
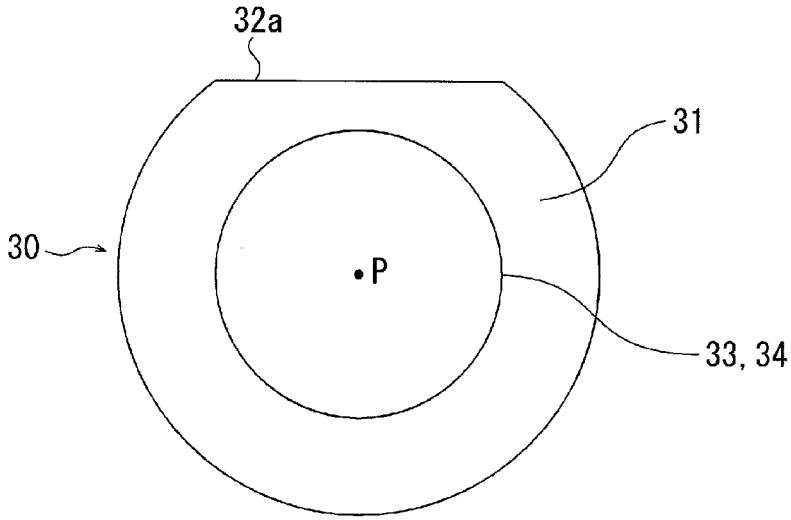
FIG. 8 is a front view of the magnetic field generator of FIG. 6.
Figure 9:
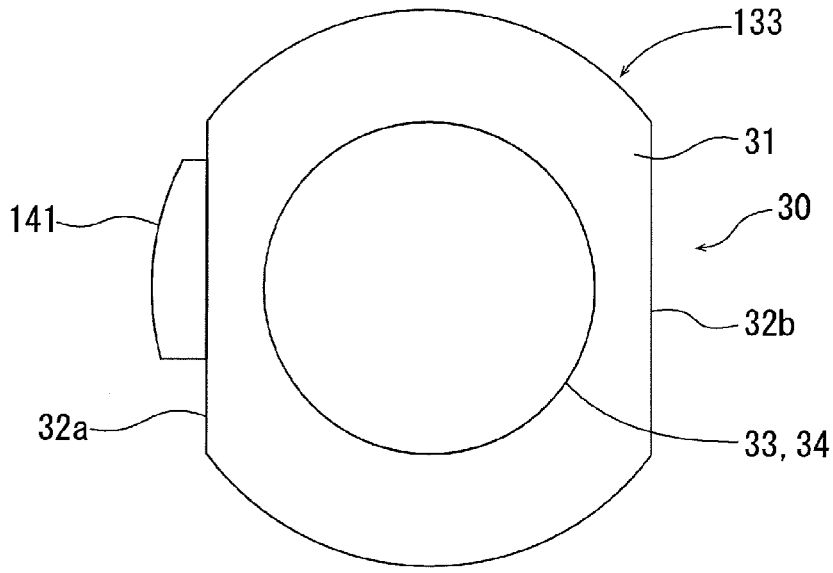
FIG. 9 is a front view of a magnet roller according to another embodiment of the present invention.
Figure 10:
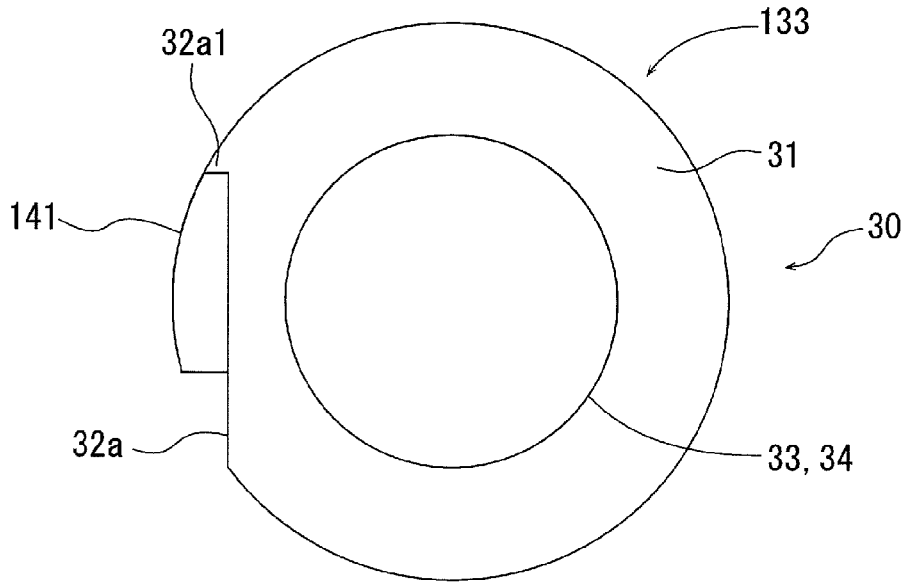
FIG. 10 is a front view of a magnet roller according to another embodiment of the present invention.
Figure 11:
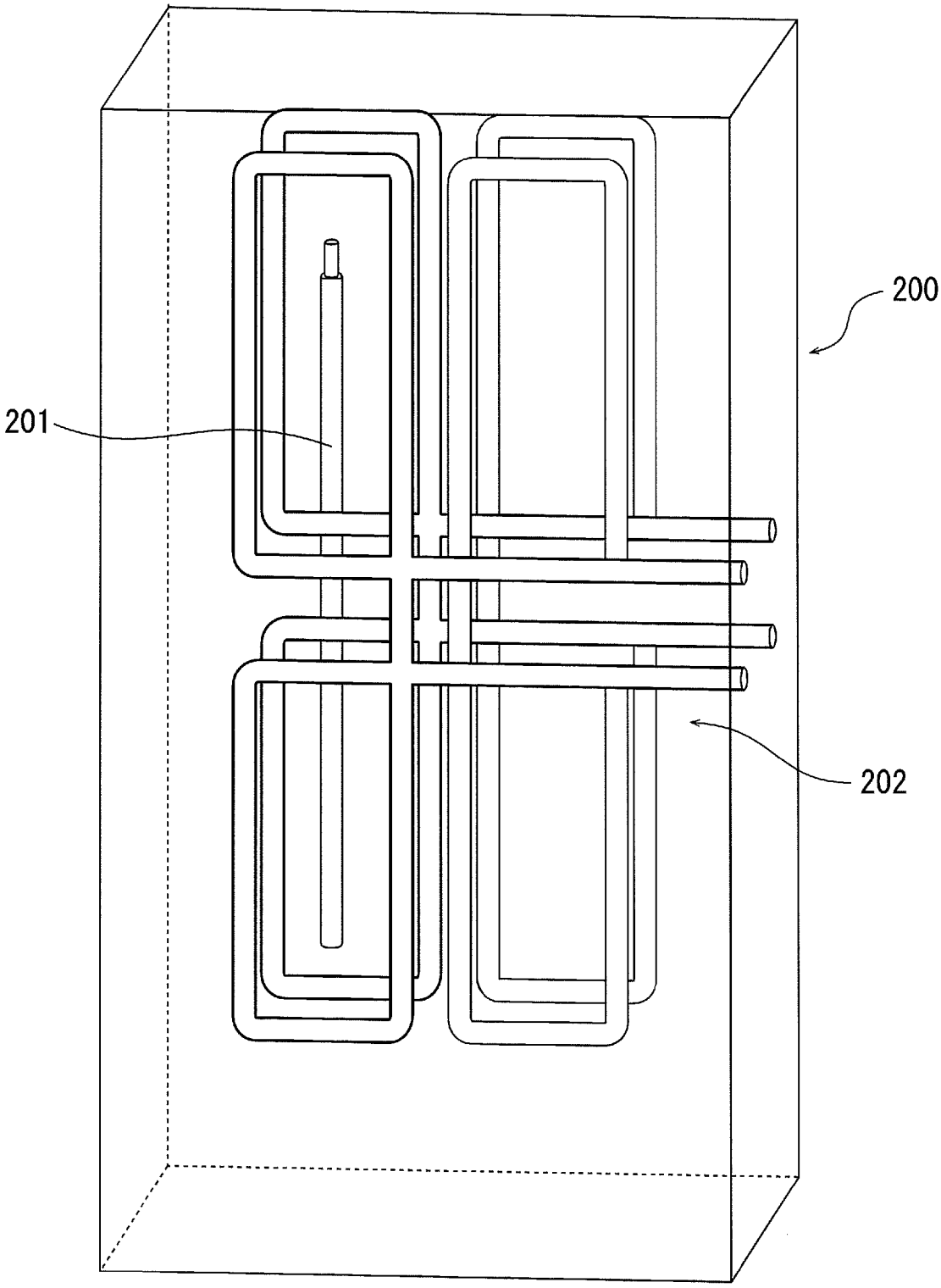
FIG. 11 schematically shows a mold of injection molding for the magnetic field generator of FIG. 6.
Figure 12:
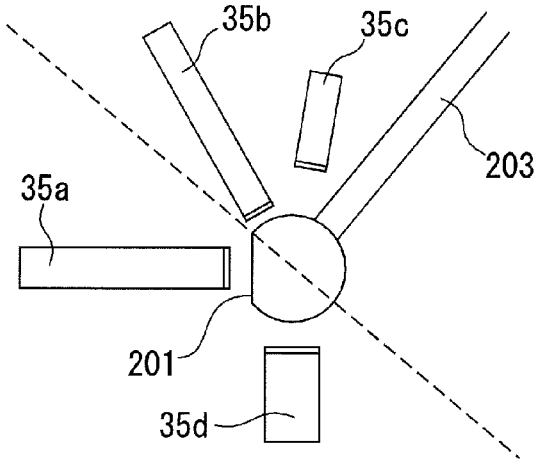
FIG. 12 cross-sectionally shows the mold of FIG. 11.

FIG. 1 cross-sectionally shows an image forming apparatus according to one embodiment of the present invention. FIG. 2 cross-sectionally shows a develop unit and a process cartridge incorporating the develop unit according to one embodiment of the present invention. FIG. 3 cross-sectionally shows a magnetic carrier contained in a developer used in the develop unit of FIG. 2. FIG. 4 cross-sectionally shows a developer holder element along the axis according to one embodiment of the present invention. FIG. 5 is a front view of a magnet roller according to one embodiment of the present invention. FIG. 6 is a perspective view of a magnetic field generator of the magnet roller of FIG. 5. FIG. 7 is a side view of the magnetic field generator of FIG. 6. FIG. 8 is a front view of the magnetic field generator of FIG. 6. FIG. 9 is a front view of a magnet roller according to another embodiment of the present invention. FIG. 10 is a front view of a magnet roller according to another embodiment of the present invention. FIG. 11 schematically shows a mold of injection molding for the magnetic field generator of FIG. 6. FIG. 12 cross-sectionally shows the mold of FIG. 11.

In FIG. 1 an image forming apparatus 101 is configured to generate a full color image of yellow (Y), magenta (M), cyan (C), black (K) on a sheet of paper 107. Herein, units associated with these colors are given numeric codes with Y, M, C, K at the end.

The image forming apparatus comprises a body 102, paper feeder units 103, a resist roller pair 110, a transfer unit 104, a fuse unit 105, four laser write units 122Y, 122M, 122C, 122K and four process cartridges 106Y, 106M, 106C, 106K.

A box-like body 102 for example is placed on the floor or the like and contains the paper feeder units 103, resist roller pair 110, transfer unit 104, fuse unit 105, laser write units 122Y, 122M, 122C, 122K, and process cartridges 106Y, 106M, 106C, 106K.

The paper feeder units 103 are provided at the bottom of the body 102 to contain a pile of paper sheets 107, and comprise detachable paper cassettes 123 and feed rollers 124. The feed rollers 124 feed the topmost paper sheets 107 to between a later-described transfer belt 129 of the transfer unit 104 and photoreceptor drums 108 (FIG. 2) of develop units 113 of the process cartridges 106Y, 106M, 106C, 106K.

The resist roller pair 110, rollers 110*a*, 110*b*, is provided on a carrier path of the paper sheet 107 from the paper feeder units 103 to the transfer unit 104. The rollers 110*a*, 110*b* hold a paper sheet 107 between them and transmit it to between the transfer unit 104 and the process cartridges 106Y, 106M, 106C, 106K at a timing when a toner image is formed.

The transfer unit 104 is provided above the paper feeder units 103 and comprises a drive roller 127, a driven roller 128, a transfer belt 129, and transfer rollers 130Y, 130M, 130C, 130K. The drive roller 127 is placed downstream of a delivery direction of the paper sheet 107 and rotated by a motor or the like. The driven roller 128 is rotatably supported by the body 102 and placed upstream of the delivery direction of the paper sheet 107. The transfer belt 129 is a loop and extends around the drive roller 127 and the driven roller 128. By rotation of the drive roller 127, the transfer belt 129 rotates counterclockwise in the drawing.

The paper sheet 107 on the transfer belt 129 is carried between the transfer rollers 130Y, 130M, 130C, 130K and the photoreceptor drums 108 of the process cartridges 106Y, 106M, 106C, 106K and toner images on the photoreceptor drums 108 are transferred onto the paper sheet 107. The transfer unit 104 transmits the paper sheet 107 having the toner image thereon to the fuse unit 105.

The fuse unit 105 is provided downstream of the delivery direction of the paper sheet 107, and comprises a roller pair 105*a*, 105*b* to press and apply heat to the paper sheet 107 sent from the transfer unit 104 to fuse the toner image on the paper sheet 107.

The laser write units 122Y, 122M, 122C, 122K are provided above the body 102 in association with the process cartridges 106Y, 106M, 106C, 106K to irradiate with laser the photoreceptor drums 108 uniformly charged by the charge rollers 109 and generate an electrostatic latent image.

The process cartridges 106Y, 106M, 106C, 106K are arranged between the transfer unit 104 and the laser write units 122Y, 122M, 122C, 122K in the delivery direction of the paper sheet 107. They are detachable from the body 102.

As shown in FIG. 2, the process cartridges 106Y, 106M, 106C, 106K each comprise a cartridge case 111, a charge roller 109, the photoreceptor drum 108, a cleaning blade 112, and a develop unit 113.

The cartridge cases 111 detachable from the body 102 each contain the charge roller 109, photoreceptor drum 108, cleaning blade 112, and develop unit 113. The charge rollers 109 evenly charge the surfaces of the photoreceptor drums 108 placed with an interval from the develop rollers 115. An electrostatic latent image is formed on the photoreceptor drums 108 cylindrical and rotatable by the laser write units 122Y, 122M, 122C, 122K. Toner is attracted to the electrostatic latent image to thereby generate a toner image. The toner image is transferred onto the paper sheet 107 on the transfer belt 129. The cleaning blades 112 remove remnant toner from the photoreceptor drums 108 after the transfer of the toner image to the paper sheet 107.

The develop unit 113 in FIG. 2 comprises a developer supply unit 114, a housing 125, a develop roller 115 as a developer holder element, and a developer blade 116.

The developer supply unit 114 comprises a container 117 and a pair of agitation screws 118. The container 117 is in a box shape in a length almost equal to the length of photoreceptor drum 108 in an axis direction and includes a partition 119 extending in a longitudinal direction to divide inside of the container 117 into a first area 120 and a second area 121. The first and second areas 120, 121 communicate with each other.

The container 117 contains developer including magnetic carrier and toner in the first and second areas 120, 121. Toner is supplied to one end of the first area in a longitudinal direction when needed and it is fine spherical particles manufactured by emulsion polymerization method or suspension polymerization method. It can be made by pulverizing a synthetic resin lump in which various dyes or pigments are mixed and dispersed or other pulverizations. The average particle size of the toner is 3 μm or more and 7 μm or less.

Magnetic carrier 135 is contained in the first and second areas 120, 121 and the average particle size thereof is 20 μm or more and 50 μm or less. It includes a core material 136, a resin coating 137 covering the surface of the core material 136, and alumina particles 138 dispersed in the resin coating, as shown in FIG. 3

The core material 136 is spherical and made of magnetic ferrite. The resin coating 137 includes charge adjusting agent and resin components in which thermoplastic resin as acrylic and melamine resin are bridged, and exerts elasticity and strong attraction. The alumina particles 138 whose diameter is larger than the thickness of the resin coating 137 are held by the strong attraction of the resin coating 137 and protrude therefrom to the outer circumference of the magnetic carrier 135.

The agitation screws 118 are accommodated in the first and second areas 120, 121 respectively. A longitudinal direction of the agitation screws 118 are in parallel to that of the container 117, the develop roller 115 and the photoreceptor drums 108. The agitation screws 118 are rotated around the axis to deliver the developer while agitating the toner and magnetic carrier 135.

In FIG. 2 the agitation screw 118 in the first area 120 delivers the developer from one end to the other in the longitudinal direction and the agitation screw 118 in the second area 121 delivers it oppositely.

Thus, the developer supply unit 114 agitates toner supplied from one end of the first area 120 with magnetic carrier 135 and delivers it to the other end and to the second area 121. It further agitates the toner and magnetic carrier 135 in the second area 121 and supplies them to the surface of the develop roller 115.

The housing 125 in a box shape is attached to the container 117 of the developer supply unit 114 to cover the container 117, the develop roller 115 and else. It includes an opening 125*a* at a portion of the housing 12 facing the photoreceptor drum 108.

The develop roller 115 is placed between the second area 121 and the photoreceptor drum 108 near the opening 125*a* in parallel to the photoreceptor drum 108 and the container 117. There is a gap between the develop roller 115 and the photoreceptor drum 108.

In FIG. 4 the develop roller 115 comprises a develop sleeve 132 and a magnet roller 133.

The develop sleeve 132 as a hollow element is made of non-magnetic materials, contains the magnet roller 133, and is rotated around the magnet roller 133 comprising a later-described main magnetic pole and fixed magnetic poles. It is made of aluminum, stainless steel (SUS) and else. Aluminum excels in workability and lightness and A6063, A5056 and A3003 are preferable. Among the stainless steel SUS303, SUS304 and SUS316 are preferable.

In FIG. 5 the magnet roller 133 comprises a magnetic field generator 30 including a cylindrical body 31 as a magnetic field generator, support elements 33, 34 and a long rare-earth magnet block 141 of a high magnetic power as a high magnetic power element.

A level face 32*a* as a level element is provided on the outer circumference of the cylindrical body 31 over the entire length in an axis P direction as shown in FIG. 6 to FIG. 8. The body 31 also includes fixed magnetic poles (north and south poles).

A first one of the fixed magnetic poles is placed to face the agitation screws 118 of the develop unit 113, and attracts the developer onto the outer face of the develop sleeve 132 or the develop roller 115 by a magnetic force. A second one of the fixed magnetic pole is placed between the first fixed magnetic pole and the level face 32*a* (main magnetic pole) downstream of the delivery direction of the developer to deliver the developer on the develop sleeve 132 or the develop roller 115 to the photoreceptor drum 108 by a magnetic force.

The body 31 includes, at a position opposite by about 180 degrees to the level face 32*a*, another magnetic pole extending along the total length of the body 31 in the axis P direction to weaken the magnetic force on the develop roller 115 and drop the developer therefrom.

The body 31 can be a plastic magnet in which magnetic powder and polymer compound are mixed or a rubber magnet. The magnetic powder can be Sr-ferrite or Ba-ferrite while the polymer compound can be PA (polyamide) materials such as 6PA, 12PA, ethylene compounds such as EEA (ethylene ethyl copolymer), EVA (ethylene vinyl copolymer), chlorine materials such as CPE (chlorinated polyethylene) or rubber materials such as NBR.

In FIG. 5 the rare-earth magnet block 141 is fixed on the level face 32*a* to form a main magnetic pole. The level face 32*a* is provided at a distance from the axis P of the body 31 greater than the radius of the support element 33.

Alternatively, another level face 32*b* as a level element can be provided on the outer face of the body 31 in the axis P direction as shown in FIG. 9. Preferably, the level face 32*b* can be provided at an opposite position (by about 180 degrees) to the level face 32*a* and at the position of the second fixed magnetic pole to drop the developer. Thereby, the body 31 becomes symmetrical in shape and a derivation in inner temperature distribution thereof can be decreased at an environmental test or the like. Therefore, by additional provision of the level face 32*b*, it is possible to greatly reduce warpage or deformation of the body 31 in the axial direction.

The support elements 33, 34 are coaxial with the body 31 and protrude from the face 31*c* of one end 31*a* and from the face 31*d* of the other end 31*b*, respectively. The end of the support element 33 is partially cut off to provide a positioning face. The outer diameter of the support elements 33, 34 is smaller than that of the body 31.

The magnetic field generator 30 in FIGS. 5 to 8 is configured to be in outer diameter ϕ10 mm, total length 223 mm and include a level face 32*a* in width 6 mm and length 223 mm, distance 5 mm from the center of the body 31, a support element 33 in outer diameter ϕ6 mm, length 35 mm, and a support element 34 in outer diameter ϕ6 mm, length 5 mm for example. In FIG. 9 the level face 32*b* is formed in width 6 mm, height 5 mm from the center of the body 31, and length 223 mm, for example. The respective elements of the magnetic field generator 30 are integrally formed by magnetic injection molding. The outer diameter or the total length of the magnetic field generator 30 should not be limited to the above examples and can be arbitrarily decided.

Preferably, the rare-earth magnet block 141 is disposed on the level face 32*a* closer to the downstream of the developer delivery direction or the rotary direction of the develop sleeve 132. This can prevent a decrease in the magnetic force between the main magnetic pole and the second fixed magnetic pole adjacent to the main magnetic pole downstream of the developer delivery direction and prevent the carrier in the developer attaching to the photoreceptor drum. The outer circumference of the rare-earth magnet block 141 is shaped to be concyclic with the outer circumference of the body 31. Because of this, it is possible to maintain a clearance between the develop sleeve 132 and the body 31 at a constant amount and generate the maximum magnetic force at the main magnetic pole.

Further, the rare-earth magnet block 141 can be disposed so that a longitudinal central line of a face contacting with the level face 32*a* coincides with a longitudinal central line of the level face 32*a*. In this case the body 31 is molded to include a level face 32*a* with a convex 32*a*1 at one end downstream of the developer delivery direction as shown in FIG. 10. Thereby, it is possible to further prevent a decrease in the magnetic force between the main magnetic pole and the second fixed magnetic pole adjacent to the main magnetic pole downstream of the developer delivery direction and prevent the carrier in the developer attaching to the photoreceptor drum.

The rare-earth magnet block 141 disposed on the level face 32*a* of the body 31 is the main magnetic pole of the magnet roller 133 and produced by magnetic compression molding. For example, it can be formed in width 30 mm, peak height 1.0 mm, length 223 mm, and outer face R5. For the purpose of exerting high magnetic property and decreasing a width, it can be made of rare earth such as neon (Ne—Fe—B) or samarium (Sm—Co, Sm—Fe—N) or can be a plastic magnet in which magnetic powder and the above polymer compound are mixed or a rubber magnet.

The developer blade 116 is provided at an end of the develop unit 113 closer to the photoreceptor drum 108, and attached to the housing 125 with a distance from the outer face of the develop sleeve 132. It adjusts an amount of the developer on the develop sleeve 132 to a desired amount by partially removing it in the container 117.

In the develop unit 113 the developer supply unit 114 sufficiently agitates the toner and the magnetic carrier 135 and the developer is attracted onto the outer face of the develop sleeve 132 by the fixed magnetic poles. Along with the rotation of the develop sleeve 132, the developer attracted by the fixed magnetic poles are delivered to the develop area 131. A developer of a desired amount adjusted by the developer blade 116 is attracted onto the photoreceptor drum 108. Thus, the developer is held on the develop roller 115 and delivered to the develop area 131 to develop an electrostatic latent image on the photoreceptor drum 108 and generate a toner image.

Then, used developer is dropped by a magnetic pole in the container 117. The used developer is accumulated and agitated with unused developer again in the second area 121 and used for developing an electrostatic latent image on the photoreceptor drum 108.

Image generation of the image forming apparatus 101 is described in the following. First, the photoreceptor drum 108 is rotated and evenly charged by the charge roller 109. Irradiated with laser, an electrostatic latent image is generated on the surface of the photoreceptor drum 108. The developer on the develop sleeve 132 of the develop unit 113 is attracted onto the surface of the photoreceptor drum 108 in the develop area 131, thereby developing the electrostatic latent image and generating a toner image on the photoreceptor drum 108.

A paper sheet 107 is delivered via the feed rollers 124 of the paper feeder unit 103 and enters between the photoreceptor drums 108 of the process cartridges 106Y, 106M, 106C, 106K and the transfer belt 129 of the transfer unit 104. Thereby, the toner image is transferred onto the paper sheet 107 from the photoreceptor drums 108. Then, the fuse unit 105 fuses the toner image on the paper sheet 107. Thus, a color image is generated on the paper sheet 107 by the image forming apparatus 101.

Next, a manufacturing method for the magnetic field generator 30 is described with reference to FIGS. 11-12. The magnetic field generator 30 is formed by injection molding using a mold 200 as shown in FIG. 11, for example. The mold 200 comprises a cavity 201 shaped in line with the shape of the magnetic field generator 30, a plurality of water pipes 202 through which cooling water for cooling the materials of the magnetic field generator 30 in the cavity 201 is circulated, and an injector pin 203 (FIG. 12).

The mold 200 also includes permanent magnets 35*a* to 35*d* as the magnetic poles around the cavity 201. The shapes (width, height, a distance from the cavity 201) of the permanent magnets 35*a* to 35*d* are different depending on required magnetic force for the magnetic poles. Permanent magnets are provided at other positions than the magnetic poles for such purposes as dropping off the developer. Owing to these permanent magnets, oriented magnetic field can be generated at the main magnetic pole so that the rare-earth magnet block 141 as being thinner (smaller in volume) than the prior art can exert the same magnitude of high magnetic force.

According to one embodiment of the present invention, the body 31 comprises the level face 32*a* at a position more apart from the axis P than the diameter of the support element 33. Because of this, the body 31 has a symmetrical shape to decrease a deviation in the inner temperature distribution at environmental testing. This makes it possible to greatly reduce a warpage or a deformation of the body 31 in the axial direction and prevent a breakage or an inclination of the support element 33. Moreover, since warpage of the body 31 is prevented at molding, it eliminates the necessity for the correction process to locally cool down the body 31 after molding. Accordingly, the deformation over time due to a warpage by the correction process is preventable and omission of the correction process can contribute to reducing the manufacture costs.

Furthermore, the rare-earth magnet block 141 is disposed closer to downstream of the developer delivery direction or the rotary direction of the develop sleeve 132. This can prevent a decrease in the magnetic force between the main magnetic pole and the adjacent fixed magnetic pole provided at downstream of the delivery direction and prevent the carriers of the developer from attaching to the photoreceptor drum. Since the outer circumference of the rare-earth magnet block 141 is shaped to be concyclic with the outer circumference of the body 31, it is possible to maintain a clearance between the develop sleeve 132 and the body 31 at a constant amount and generate the maximum magnetic force at the main magnetic pole.

Moreover, the develop roller 115 including the above-described magnet roller 133 can maintain high magnetic force at the main magnetic pole, greatly reduce a warpage or a deformation of the body 31 in the axial direction and prevent a breakage or an inclination of the support elements. The develop roller 115 can be manufactured at less cost.

Likewise, the develop unit 113 including the above develop roller 115 can maintain high magnetic force at the main magnetic pole of the magnetic field generator 30, greatly reduce a warpage or a deformation of the body 31 in the axial direction and prevent a breakage or an inclination of the support element. It can be manufactured at less cost.

Likewise, the process cartridges 106Y, 106M, 106C, 106K each including the develop unit 113 can maintain high magnetic force at the main magnetic pole of the magnetic field generator 30, greatly reduce a warpage or a deformation of the body 31 in the axial direction and prevent a breakage or an inclination of the support elements. They can be manufactured at less cost.

Likewise, the image forming apparatus 101 including the above process cartridges 106Y, 106M, 106C, 106K can maintain high magnetic force at the main magnetic pole of the magnetic field generator 30, greatly reduce a warpage or a deformation of the body 31 in the axial direction and prevent a breakage or an inclination of the support elements. It can be manufactured at less cost.

Next, the inventors of the present invention conducted tests to confirm the effects of the present invention. Using a plurality of different magnet rollers 133 each including a level face on the outer circumference of a body, an amount of warpage of the body occurring at injection molding of a magnetic field generator and an amount of inclination of a support element were measured.

In the following specific examples of results will be described with reference to FIGS. 13 to 29. The magnetic field generator 30 was molded with the mold 200 using a compound of anisotropic Sr-ferrite and PA12 manufactured by Toda Kogyo Corp.

The magnetic field generator 30 was molded under a condition that resin temperature is 300 degrees, mold temperature is 80 degrees, injection time is 0.8 second, applied pressure is 60 MPa, pressure time is 4 seconds, and cooling time is 35 seconds.

The target peak magnetic force is set to 105±5 mT at the main magnetic pole (P1), 74±5 mT at the fixed magnetic pole (P2) at downstream of the rotary direction of the develop sleeve, and 30±5 T at the fixed magnetic pole (P3) for attracting the developer.

First Example

The magnetic field generator 30 in this example is the same as that in FIG. 5. That is, the body 31 has an outer diameter ϕ10 mm, total length 223 mm and includes a level face 32*a* in width 6.0 mm, height 4.0 mm from the center of the magnetic field generator 30 and length 223 mm, a support element 33 in outer diameter ϕ6 mm, length 35 mm, and a support element 34 in outer diameter ϕ6 mm, length 5 mm. The rare-earth magnet block 141 in width 3.5 mm, peak height 1.0 mm, length 223 mm, and outer face R5 is disposed on the level face 32*a*, extending in the axial direction. The rare-earth magnet block 141 is disposed so that a longitudinal central line of a face contacting with the level face 32*a* shifts from a longitudinal central line of the level face 32*a* by 0.5 mm to the downstream of the developer delivery direction.

Figure 13:
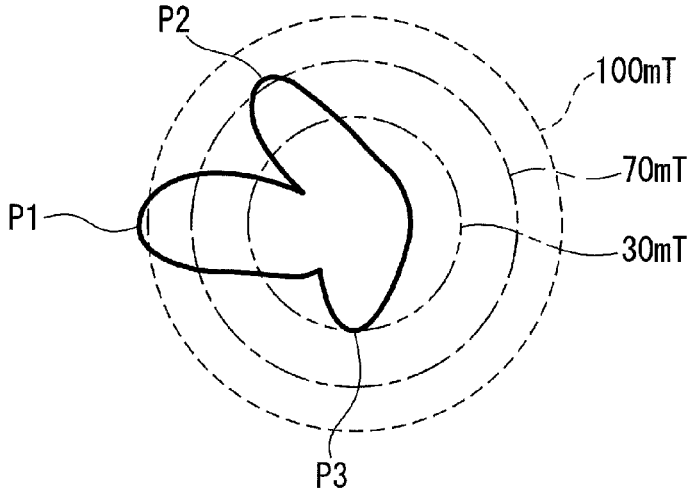
FIG. 13 shows a magnetic waveform of a magnet roller in a first example.

In FIG. 13 the magnetic forces obtained were 105.3 mT at P1, 74.2 mT at P2, and 30 mT at P3 on the develop sleeve 132 of ϕ12, satisfying the respective target magnetic forces.

Second Example

The magnetic field generator 30 is the same as that in the first example except for additionally including a level face 32*b* on the outer circumference of the body 31 to face the level face 32*a* as shown in FIG. 9. The level face 32*b* is in width 6.0 mm, height 4.0 mm from the center of the magnetic field generator 30, length 223 nm. As in the first example, the rare-earth magnet block 141 is disposed so that a longitudinal central line of a face contacting with the level face 32*a* shifts from a longitudinal central line of the level face 32*a* by 0.5 mm to the downstream of the developer delivery direction.

Figure 14:
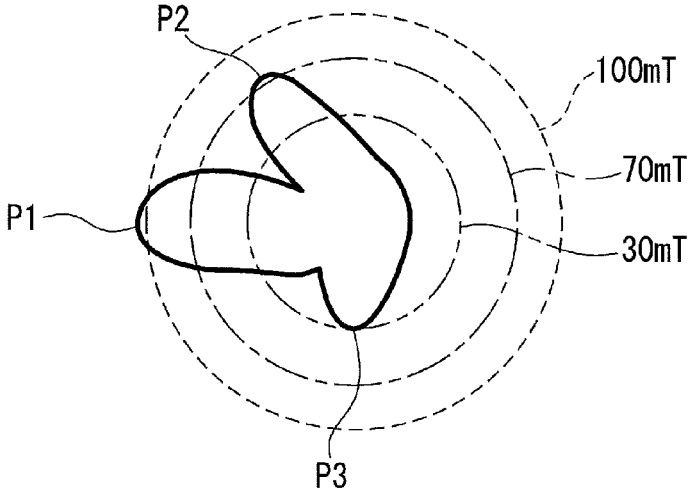
FIG. 14 shows a magnetic waveform of a magnet roller in a second example.

In FIG. 14 the magnetic forces obtained were 105.4 mT at P1, 74.3 mT at P2, and 29.9 mT at P3 on the develop sleeve 132 of ϕ12, satisfying the respective target magnetic forces.

Third Example

In the magnetic field generator 30 of this example in FIG. 10, the body 31 is in outer diameter ϕ10 mm, total length 223 nm, and the level face 32*a* is in width 5.0 mm, height 4.0 mm from the center of the magnetic field generator 30, and length 223 nm. The level face 32*a* includes a convex 32*a*1 at downstream of the developer delivery direction or the rotary direction of the develop sleeve 132. The convex 32*a*1 is concyclic with the outer circumference of the body 31. A support element 33 is in outer diameter ϕ6 mm, length 35 mm, and a support element 34 is in outer diameter ϕ6 mm, length 5 mm. The rare-earth magnet block 141 on the level face 32*a* is in width 3.5 mm, peak height 1.0 mm, length 223 nm, outer face R5. The rare-earth magnet block 141 is disposed so that a longitudinal central line of a face contacting with the level face 32*a* coincides with a longitudinal central line of the level face 32*a*.

Figure 15:
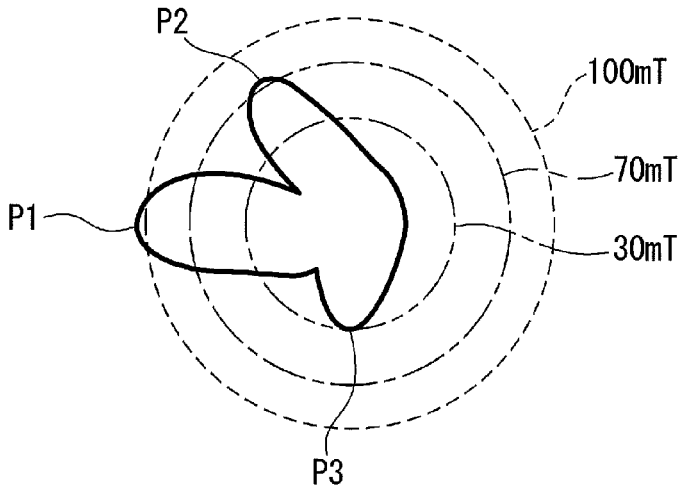
FIG. 15 shows a magnetic waveform of a magnet roller in a third example.

The magnetic forces obtained were 105.7 mT at P1, 74.7 mT at P2, and 30.1 mT at P3 on the develop sleeve 132 of ϕ12, satisfying the respective target magnetic forces as shown in FIG. 15.

Fourth Example

Figure 16:
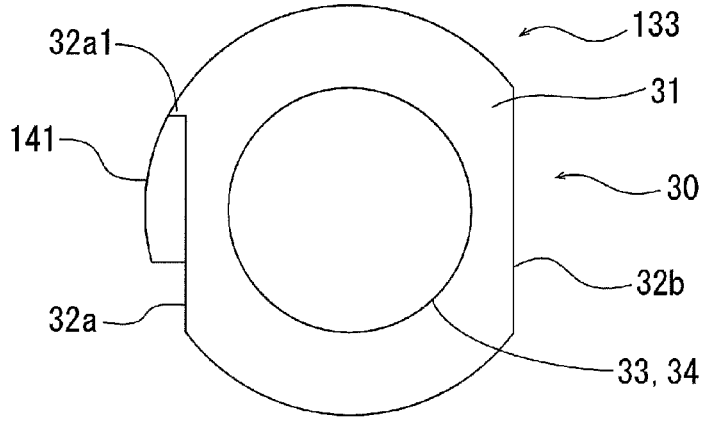
FIG. 16 is a front view of a magnet roller in a fourth example.

The magnetic field generator 30 is the same as that in the third example except for additionally including a level face 32*b* on the outer circumference of the body 31 to face the level face 32*a* as shown in FIG. 16. The level face 32*b* is in width 6.0 mm, height 4.0 mm from the center of the magnetic field generator 30, length 223 nm. The rare-earth magnet block 141 is disposed so that a longitudinal central line of a face contacting with the level face 32*a* coincides with a longitudinal central line of the level face 32*a*.

Figure 17:
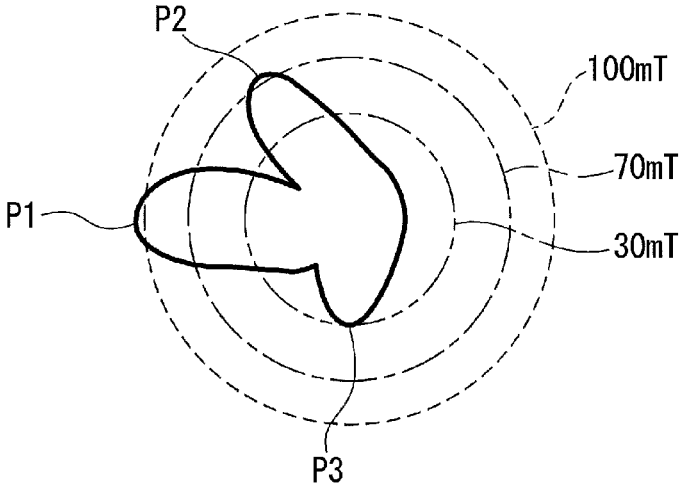
FIG. 17 shows a magnetic waveform of a magnet roller in the fourth example.

The magnetic forces obtained were 105.8 mT at P1, 74.7 mT at P2, and 29.9 mT at P3 on the develop sleeve 132 of ϕ12, satisfying the respective target magnetic forces as shown in FIG. 17.

Fifth Example

Figure 18:
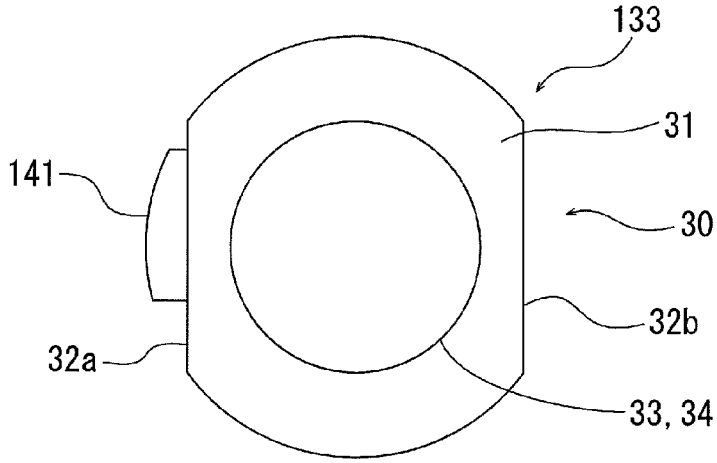
FIG. 18 is a front view of a magnet roller in a fifth example.

In the magnetic field generator 30 of this example in FIG. 18, the body 31 is in outer diameter ϕ9 mm, total length 223 nm, and the level face 32*a* is in width 5.7 mm, height 3.5 mm from the center of the magnetic field generator 30 and length 223 nm. The magnetic field generator 30 additionally includes a level face 32*b* on the outer circumference of the body 31 to face the level face 32*a*. The level face 32*b* is in width 5.7 mm, height 3.5 mm from the center of the magnetic field generator 30, and length 223 nm. It also includes two support elements 33, 34, one 33 in outer diameter ϕ6 mm, length 35 mm, the other 34 in outer diameter ϕ6 mm, length 5 mm. The rare-earth magnet block 141 on the level face 32*a* is in width 3.5 mm, peak height 1.0 mm, length 223 nm, outer face R5. The rare-earth magnet block 141 is disposed so that a longitudinal central line of a face contacting with the level face 32*a* shifts from a longitudinal central line of the level face 32*a* by 0.5 mm to downstream of the rotary direction of the develop sleeve 132 or the developer delivery direction.

Figure 19:
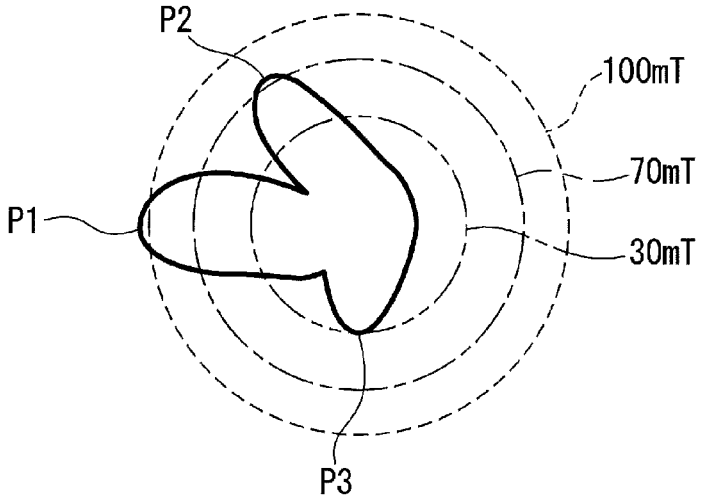
FIG. 19 shows a magnetic waveform of a magnet roller in the fifth example.

The magnetic forces obtained were 104.4 mT at P1, 73.6 mT at P2, and 29.6 mT at P3 on the develop sleeve 132 of ϕ11, satisfying the respective target magnetic forces as shown in FIG. 19.

Sixth Example

Figure 20:
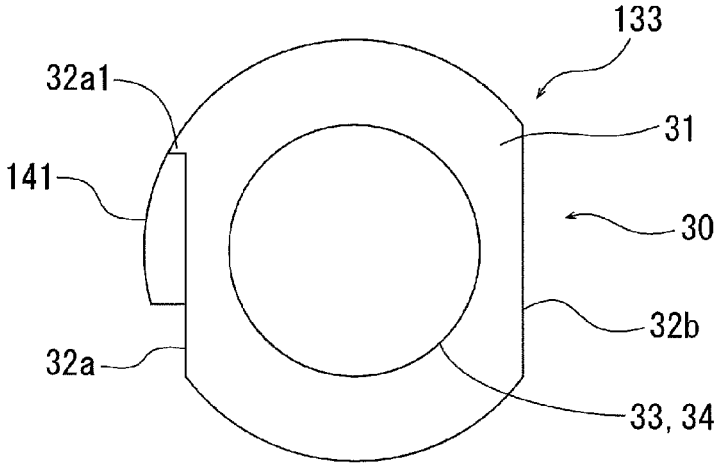
FIG. 20 is a front view of a magnet roller in a sixth example.

In the magnetic field generator 30 of this example in FIG. 20, the body 31 is in outer diameter ϕ8 mm, total length 223 nm, and the level face 32*a* is in width 4.7 mm, height 4.0 mm from the center of the magnetic field generator 30 and length 223 nm. The level face 32*a* includes a convex 32*a*1 at downstream of the developer delivery direction or the rotary direction of the develop sleeve 132. The convex 32*a*1 is concyclic with the outer circumference of the body 31. The magnetic field generator 30 additionally includes a level face 32*b* on the outer circumference of the body 31 to face the level face 32*a*. The level face 32*b* is in width 5.7 mm, height 3.5 mm from the center of the magnetic field generator 30, and length 223 nm. The magnetic field generator 30 also includes two support elements 33, 34, one 33 in outer diameter ϕ6 mm, length 35 mm, the other 34 in outer diameter ϕ6 mm, length 5 mm. The rare-earth magnet block 141 on the level face 32*a* is in width 3.5 mm, peak height 1.0 mm, length 223 nm, outer face R5. The rare-earth magnet block 141 is disposed so that a longitudinal central line of a face contacting with the level face 32*a* coincides with a longitudinal central line of the level face 32*a*.

Figure 21:
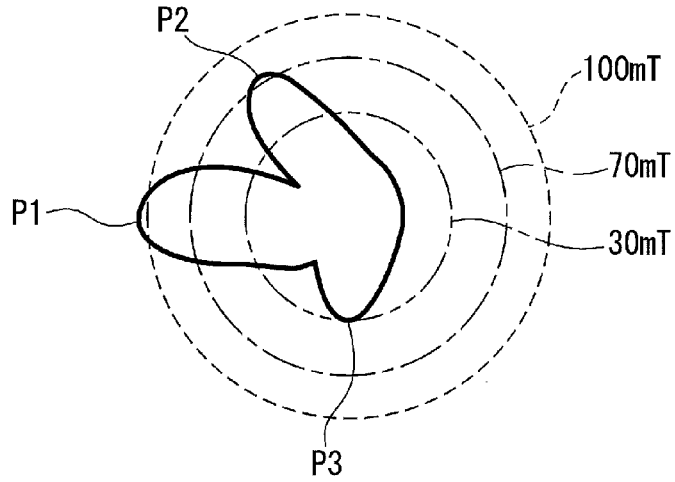
FIG. 21 shows a magnetic waveform of a magnet roller in the sixth example.

The magnetic forces obtained were 103.3 mT at P1, 72.8 mT at P2, and 29.3 mT at P3 on the develop sleeve 132 of ϕ12, satisfying the respective target magnetic forces as shown in FIG. 21.

Seventh Example

Figure 22:
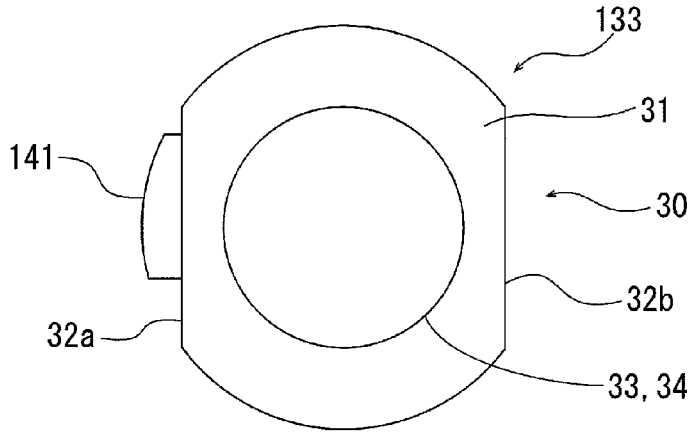
FIG. 22 is a front view of a magnet roller in a seventh example.
Figure 23:
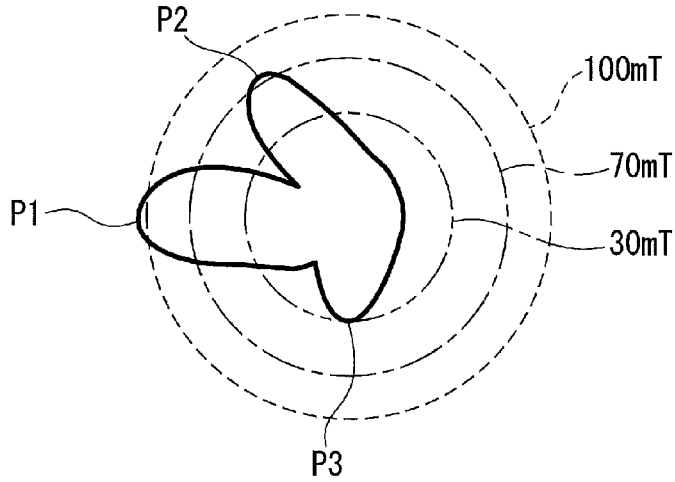
FIG. 23 shows a magnetic waveform of a magnet roller in the seventh example.

In the magnetic field generator 30 of this example in FIG. 22, the body 31 is in outer diameter ϕ9 mm, total length 223 nm, and the level face 32*a* is in width 5.7 mm, height 3.5 mm from the center of the magnetic field generator 30 and length 223 nm. The magnetic field generator 30 additionally includes a level face 32*b* on the outer circumference of the body 31 to face the level face 32*a*. The level face 32*b* is in width 5.7 mm, height 3.5 mm from the center of the magnetic field generator 30, and length 223 nm. A support element 33 is in outer diameter ϕ6 mm, length 35 mm, and a support element 34 is in outer diameter ϕ6 mm, length 5 mm. The rare-earth magnet block 141 on the level face 32*a* is in width 3.5 mm, peak height 1.0 mm, length 223 nm, outer face R5. The rare-earth magnet block 141 is disposed so that a longitudinal central line of a face contacting with the level face 32*a* coincides with a longitudinal central line of the level face 32*a*.

The magnetic forces obtained were 104.4 mT at P1, 73.6 mT at P2, and 31.0 mT at P3 on the develop sleeve 132 of ϕ12, satisfying the respective target magnetic forces.

Eighth Example

Figure 24:
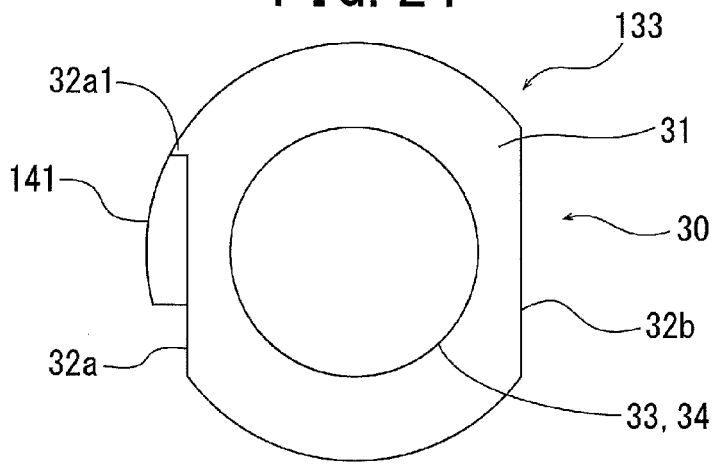
FIG. 24 is a front view of a magnet roller in an eighth example.

In the magnetic field generator 30 of this example in FIG. 24, the body 31 is in outer diameter ϕ8 mm, total length 223 nm, and the level face 32*a* is in width 4.3 mm, height 3.0 mm from the center of the magnetic field generator 30 and length 223 nm. The level face 32*a* includes a convex 32*a*1 at downstream of the developer delivery direction or the rotary direction of the develop sleeve 132. The convex 32*a*1 is concyclic with the outer circumference of the body 31. The magnetic field generator 30 additionally includes a level face 32*b* on the outer circumference of the body 31 to face the level face 32*a*. The level face 32*b* is in width 5.3 mm, height 3.0 mm from the center of the magnetic field generator 30, and length 223 nm. It also includes two support elements 33, 34, one 33 in outer diameter ϕ6 mm, length 35 mm, the other 34 in outer diameter ϕ6 mm, length 5 mm. The rare-earth magnet block 141 on the level face 32*a* is in width 3.5 mm, peak height 1.0 mm, length 223 nm, outer face R5. The rare-earth magnet block 141 is disposed so that a longitudinal central line of a face contacting with the level face 32*a* coincides with a longitudinal central line of the level face 32*a*.

Figure 25:
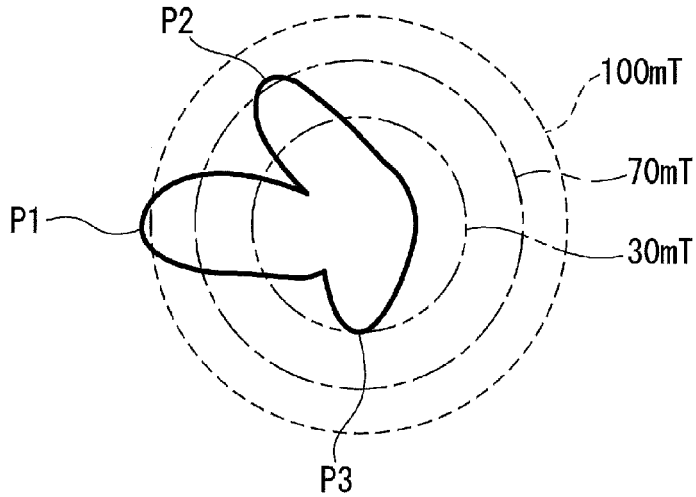
FIG. 25 shows a magnetic waveform of a magnet roller in the eighth example.

The magnetic forces obtained were 103.6 mT at P1, 73.2 at P2, and 33.8 mT at P3 on the develop sleeve 132 of ϕ12, satisfying the respective target magnetic forces as shown in FIG. 25.

Ninth Example

Figure 26:
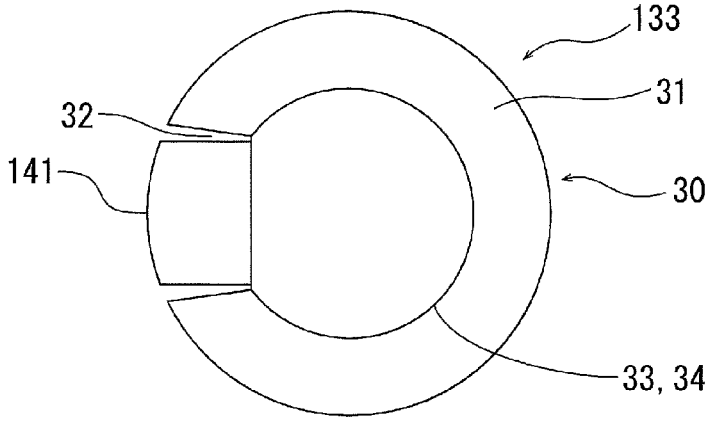
FIG. 26 is a front view of a magnet roller in a ninth example.

The magnetic field generator 30 in this example in FIG. 26 includes a body 31 with a groove 32. The body 31 is in outer diameter ϕ10 mm, total length 223 mm, and the groove 32 is in width 3.8 mm, height 2.55 mm from the center of the magnetic field generator 30 and length 223 nm. Also, two support elements 33, 34, one 33 in outer diameter ϕ6 mm, length 35 mm, the other 34 in outer diameter ϕ6 mm, length 5 mm are formed. The rare-earth magnet block 141 in a cubic shape is placed in the groove 32, extending in the axial direction of the develop roller 115 and it is in width 3.4 mm, peak height 2.25 mm, length 223 nm.

Figure 27:
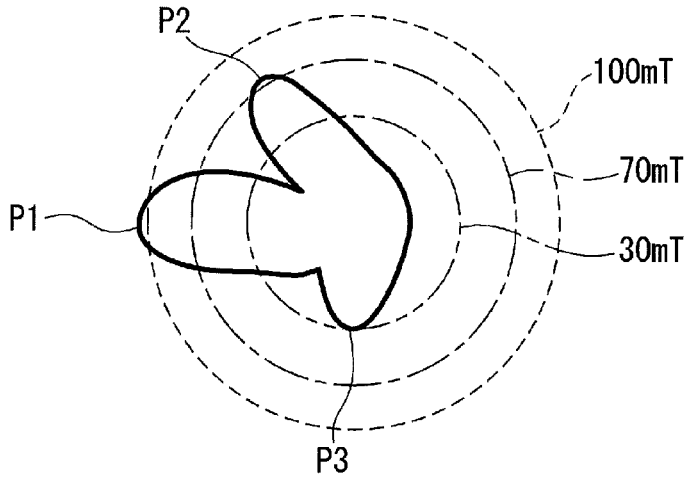
FIG. 27 shows a magnetic waveform of a magnet roller in the ninth example.

The magnetic forces obtained were 106.7 mT at P1, 72.8 mT at P2, and 29.6 mT at P3 on the develop sleeve 132 of ϕ12, satisfying the respective target magnetic forces as shown in FIG. 27.

Tenth Example

Figure 28:
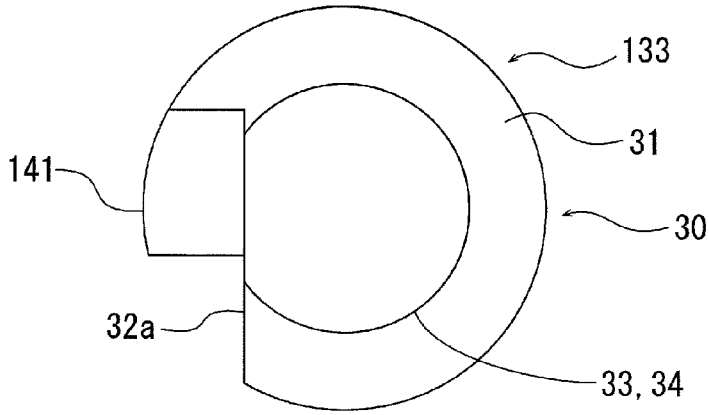
FIG. 28 is a front view of a magnet roller in a tenth example.

In the magnetic field generator 30 of this example in FIG. 28, the body 31 is in outer diameter ϕ10 mm, total length 223 nm, and the level face 32*a* is in width 6.0 mm, height 2.55 mm from the center of the magnetic field generator 30 and length 223 nm. The magnetic field generator 30 also includes a convex at downstream of the developer delivery direction or the rotary direction of the develop sleeve 132. The convex is concyclic with the outer circumference of the body 31. Also, two support elements 33, 34, one 33 in outer diameter ϕ6 mm, length 35 mm, the other 34 in outer diameter ϕ6 mm length 5 mm are formed. The rare-earth magnet block 141 on the level face 32*a* is in width 3.5 mm, peak height 2.45 mm, length 223 nm, outer face R5. The rare-earth magnet block 141 is disposed so that a longitudinal central line of a face contacting with the level face 32*a* is shifted from a longitudinal central line of the level face 32*a* by 0.5 mm to the downstream of the developer delivery direction.

Figure 29:
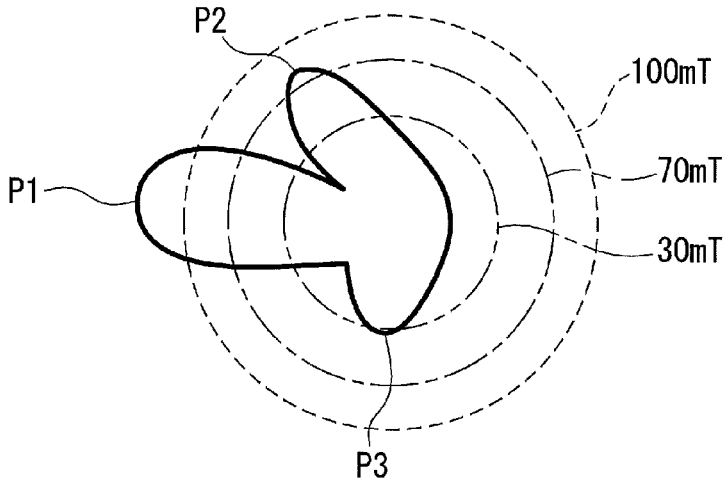
FIG. 29 shows a magnetic waveform of a magnet roller in the tenth example.

The magnetic forces obtained were 130.5 mT at P1, 79.4 mT at P2, and 29.3 mT at P3 on the develop sleeve 132 of ϕ12, satisfying the respective target magnetic forces as shown in FIG. 29.

Next, amounts of warpage of the body and amounts of inclination of the support element measured at injection molding in the first to tenth examples are shown in Table 1. Results A, B, C in the Table are defined as follows.

Measurement Results of Warpage of Body

A amount of warpage less than 40 μm

B amount of warpage less than 70 μm

C amount of warpage 70 μm or more

Measurement Results of Inclination of Support Element

A amount of inclination less than 10 μm

B amount of inclination less than 20 μm

C amount of inclination 20 μm or more

TABLE

| | Warpage of Body | Result | Inclination of Support Element | Result |
|---|---|---|---|---|
| 1st Example | 45 μm | B | 7.9 μm | A |
| 2nd Example | 21 μm | A | 7.5 μm | A |
| 3rd Example | 65 μm | B | 8.6 μm | A |
| 4th Example | 50 μm | B | 8.3 μm | A |
| 5th Example | 20 μm | A | 7.6 μm | A |
| 6th Example | 48 μm | B | 8.5 μm | A |
| 7th Example | 21 μm | A | 7.8 μm | A |
| 8th Example | 49 μm | B | 8.4 μm | A |
| 9th Example | 431 μm | C | 25.0 μm | C |
| 10th Example | 244 μm | C | 21.0 μm | C |

According to the Table, good results were obtained in terms of the warpage of the body and the inclination of the support element in the first to tenth examples. It is obvious from the above that by provision of the level face 32*a* on the outer circumference of the body 31 and the rare-earth magnet block 141 fixed on the level face 32*a*, it is able to greatly reduce warpage of the body in the axial direction and inclination of the support element at molding.

Further, with inclusion of the level face 32*b* on the outer circumference of the body 31 in addition to the level face 32*a*, warpage of the body in the axial direction and inclination of the support element at molding can be further prevented.

Through the examples, like magnetic waveforms were obtained as shown in FIGS. 13-15, 17, 19, 21, 23, 25. Specially, the develop roller sufficiently functioned to generate high magnetic force at the main magnetic pole.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A develop unit comprising:

a magnet roller comprising a magnetic field generator being columnar, a support element being columnar, coaxially provided at both ends of the magnetic field generator, the support element having a diameter smaller than that of the magnetic field generator, a level element extending along an axis of the magnetic field generator, with a distance of the level element from the axis being larger than a radius of the support element, and a high magnetic power element being a main magnetic pole provided on the level element, extending longitudinally along the axis of the magnetic field generator; and a develop roller comprising a cylindrical hollow element containing the magnet roller and rotatable around the axis of the magnetic field generator, wherein the high magnetic power element is disposed on the level element so that a longitudinal central line on a face of the high magnetic power element contacting with the level element is shifted, relative to an axial central line of the level element, downstream of a rotary direction of the hollow element.

2. A develop unit according to claim 1, wherein the magnetic field generator comprises another level element at such a position to face, across the axis of the magnetic field generator, the level element on which the high magnetic power element is provided.

3. A develop unit according to claim 1, wherein an outer circumference of the high magnetic power element is shaped to be concyclic with that of the magnetic field generator.

4. A develop unit according to claim 1, wherein the level element includes a convex portion at one end at downstream of a rotary direction of the hollow element on which the high magnetic power element is provided, the convex portion contacting with the high magnetic power element.

5. A process cartridge comprising the develop unit according to claim 1.

6. An image forming apparatus comprising the process cartridge according to claim 5.

* * * * *